US007462981B2

(12) United States Patent
Hwang

(10) Patent No.: US 7,462,981 B2
(45) Date of Patent: Dec. 9, 2008

(54) ELECTRON EMISSION DEVICE INCLUDING CONDUCTIVE LAYERS FOR PREVENTING ACCUMULATION OF STATIC CHARGE

(75) Inventor: Seong-Yeon Hwang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 546 days.

(21) Appl. No.: 11/138,239

(22) Filed: May 26, 2005

(65) Prior Publication Data

US 2005/0264156 A1 Dec. 1, 2005

(30) Foreign Application Priority Data

May 31, 2004 (KR) ..... 10-2004-0038989

(51) Int. Cl.
*H01J 1/02* (2006.01)
*H01J 9/00* (2006.01)

(52) U.S. Cl. ..... 313/495; 313/311; 313/496; 313/310; 445/24; 445/25

(58) Field of Classification Search ..... 313/309–310, 313/495–497, 582–587, 500–512, 336, 351, 313/498, 306, 346, 355, 293–304; 315/169.3, 315/169.4; 345/55, 75.2; 445/24, 25
See application file for complete search history.

(56) References Cited

U.S. PATENT DOCUMENTS 5,760,535 A * 6/1998 Moyer et al. ..... 313/309
5,929,560 A 7/1999 Trujillo et al.

FOREIGN PATENT DOCUMENTS

CN 1181613 A 5/1998

* cited by examiner

*Primary Examiner*—Mariceli Santiago
*Assistant Examiner*—Donald L Raleigh
(74) *Attorney, Agent, or Firm*—Christie, Parker & Hale, LLP

(57) ABSTRACT

An electron emission device with conductive layers for preventing accumulation of static charges on an insulating layer of the device is shown that does not require an independent driving circuit. The device includes cathode electrodes formed on a substrate and separated from gate electrodes by an insulating layer formed over the cathode electrodes, all inside a partial vacuum chamber. Crossings of cathode and gate electrodes form the display areas while in the non-display areas of the insulating layer, that are susceptible to accumulation of electrostatic charge, conductive layers are formed parallel to the cathode or gate electrodes, for the most part separated from these electrodes by the insulating layer. Outside the device chamber, the conductive layers are electrically coupled to their corresponding electrodes. Conductive layers thus formed and coupled discharge accumulated static charge over the insulating layers inside the device to the outside circuit.

20 Claims, 3 Drawing Sheets

ELECTRON EMISSION DEVICE INCLUDING CONDUCTIVE LAYERS FOR PREVENTING ACCUMULATION OF STATIC CHARGE

CROSS REFERENCE TO RELATED APPLICATION

This application claims priority to and the benefit of Korean Patent Application No. 10-2004-0038989 filed on May 31, 2004 in the Korean Intellectual Property Office, the entire content of which is incorporated herein by reference.

BACKGROUND OF THE INVENTION

1. Field of the Invention

The present invention relates to an electron emission device, and in particular, to an electron emission device which has an electrode structure for preventing the electrostatic charges from being accumulated on the insulating layer.

2. Description of Related Art

Generally, electron emission devices are classified into a first type where a hot cathode is used as an electron emission source, and a second type where a cold cathode is used as the electron emission source. The cold cathode electron emission devices, in turn, include field emitter array (FEA) devices, surface conduction emitter (SCE) devices, metal-insulator-metal (MIM) devices, metal-insulator-semiconductor (MIS) devices, and ballistic electron surface emitter (BSE) devices.

Electron emission devices may have different structures depending on their specific type. However, most types include two substrates separated by some form of a spacer and forming a vacuum chamber in the space between the two substrates. An electron emission structure with driving electrodes is formed at one of the substrates to emit electrons. Phosphor layers and an electron accelerating electrode are formed on the other substrate to emit light and display the desired images. The driving electrodes are usually formed with two electrodes placed perpendicular to each other.

The rate of electron emission is controlled through operating the driving electrodes by the well-known matrix address technique. An insulating layer is formed between the first and the second electrodes to electrically insulate the two from each other. The substrate with the electron emission structure, and the substrate with the phosphor layers are usually parallel to each other with a distance in between. A sealing material, such as a frit, is used to seal the substrates to each other to form the vacuum chamber. The vacuum chamber, thus formed, is partitioned into a display area and a non-display area.

In electron emission devices with the above conventional structures, the insulating layer in the display area is usually covered with one or two electrodes. On the other hand, the insulating layer in the non-display area around the frit-coated sealing line is not covered by electrodes while being exposed to the vacuum inside the chamber. As a result of this structure, static charges are accumulated on the insulating layer of conventional electron emission devices in the non display areas and cause device failures such as abnormal operation, arcing, and flashover.

In order to prevent these problems, U.S. Pat. No. 5,929,560 discloses a field emission display device where an ion shield layer is formed on the insulating layer in the non-display area to prevent the accumulation of static charges on the insulating layer. The ion shield layer is electrode layer supplied with a voltage independently from the electrodes placed at the display area, and prevents static charges from accumulating on the insulating layer in the non-display area.

In conventional techniques, including the ion shield technique explained above, because the ion shield layer receives its driving voltage from an IC separate from the IC used for driving the emission electrode, the number of structural components and therefore the cost of production, are increased.

SUMMARY OF THE INVENTION

In one exemplary embodiment of the present invention, there is provided an electron emission device which prevents the static charges from being accumulated on the insulating layer without introducing a separate driving IC.

In an exemplary embodiment of the present invention, an electron emission device includes first electrodes formed on a substrate with a predetermined pattern, and an insulating layer formed on the substrate while covering the first electrodes. Second electrodes are formed on the insulating layer with a predetermined pattern. At least two conductive layers are formed at the periphery of the insulating layer parallel to the first electrodes while partially covering the insulating layer. The conductive layers are electrically coupled to the first electrodes.

The conductive layers are in one to one correspondence with the first electrodes. The respective conductive layers are electrically connected to the corresponding first electrodes.

The first electrode has an end portion exposed to the outside of the insulating layer, and the conductive layer contacts the lateral side of the insulating layer as well as the top surface of the first electrode.

The electron emission device further includes electron emission regions electrically connected to one of the first and the second electrodes.

The second electrode and the insulating layer have opening portions partially exposing the first electrode, and the electron emission regions are formed on the first electrode within the opening portions. The electron emission regions contact the second electrodes.

In another exemplary embodiment of the present invention, an electron emission device includes first and second substrates facing each other, and first electrodes formed on the first substrate with a predetermined pattern. An insulating layer is formed on the first substrate while covering the first electrodes. Second electrodes are formed on the insulating layer with a predetermined pattern. At least two conductive layers are formed on the periphery of the insulating layer parallel to the first electrodes while partially covering the insulating layer. The conductive layers are electrically connected to the first electrodes. At least a third electrode is formed on the second substrate. Phosphor layers are formed on a surface of the third electrode.

DETAILED DESCRIPTION

Figure 1:
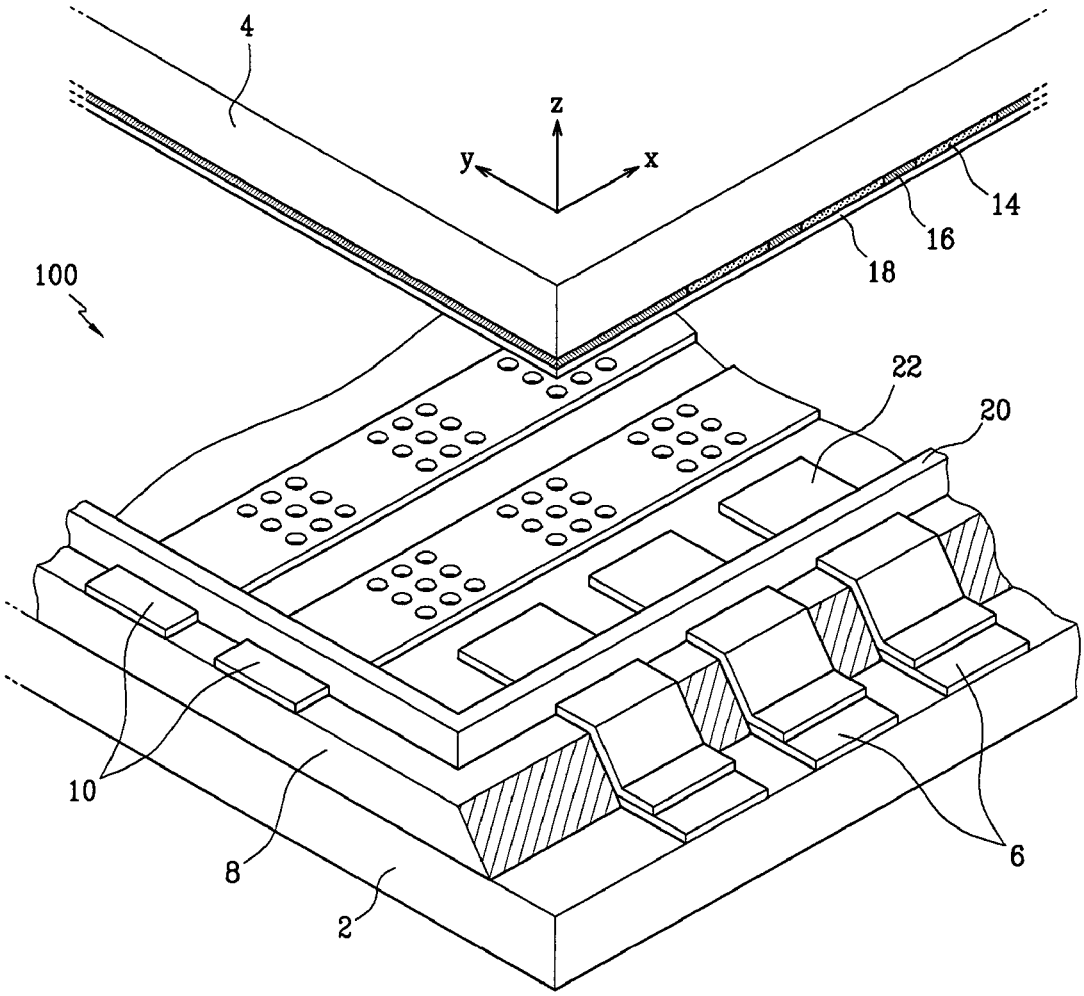
FIG. 1 is a simplified diagram showing, in perspective, a portion of one embodiment of an electron emission device constructed in accordance with the invention.

As seen in FIG. 1, in one embodiment the electron emission device 100 includes first substrate 2 and second substrate 4 parallel to each other. The substrates 2, 4 are assembled by attaching them to each other via a sealing member 20 leaving a distance in between the substrates 2, 4. The inner space between the substrates 2, 4 is exhausted to be in a partial vacuum state hence creating a vacuum chamber between the substrates.

As a set of first electrodes, a number of cathode electrodes 6 are formed, in a stripe pattern, on the first substrate 2. Stripes of cathode electrodes 6 are spaced apart from one another and are formed, for example, along the y-axis of the drawing in FIG. 1. An insulating layer 8 is formed on the surface of the first substrate 2 covering the cathode electrodes 6. A number of gate electrodes 10 are formed on the insulating layer 8, in another stripe pattern, as a set of second electrodes. Stripes of gate electrodes 10 are spaced apart from one another and run along a direction perpendicular to the direction of cathode electrodes 6 stripes. For example, if the cathode electrodes 6 run along the y-axis in the drawing of FIG. 1, then the gate electrodes 10 run along the x-axis of the same drawing. The regions where the cathode electrodes 6 and the gate electrodes 10 cross paths are called pixel regions. The area of the substrate 2 where the pixel regions are located, and where, thereby, electron emissions are substantially realized, is called the display area. Non-display area may not correspond to the display area. In some embodiments, the non-display area may correspond to the regions near the margins and perimeter of the vacuum chamber where the two substrates are attached together.

Conductive layers 22 cover portions of the insulating layer 8 and are electrically coupled to the cathode electrode 6 outside the vacuum chamber. In one embodiment a number of conductive layers 22 may be formed on the portions of the insulating layer 8 in the non-display areas. For example, the conductive layers 22 may be formed in stripes over the insulating layer 8 proceeding in a direction perpendicular to the gate electrodes 10. In some example embodiments, the stripes of conductive layers 22 stop near the inner perimeter of the vacuum chamber and do not reach the gate electrodes 10. In this embodiment, the conductive layers 22 may be parallel to the cathode electrodes 6 running along and over the cathode electrodes 6 where the cathode electrodes run under the insulating layer 8 and the conductive layers 22 run over the insulating layer 8. There may be a one to one correspondence between the conductive layers 22 and the cathode electrodes 6.

The areas of highest concern for accumulation of static charges are the non-display areas. Some of the non-display areas may be located near the perimeter of the vacuum chamber where the insulating layer 8 may be exposed and may accumulate charge without an opportunity to discharge the charge through metal or other conductive material. As a result, in some embodiments, the conductive layers 22 may not extend along the entire length of the cathode electrodes 6. The conductive layers 22 shown in FIG. 1 extend only partially into the vacuum chamber and stay generally near the inner perimeter of the chamber.

Red, green and blue phosphor layers 14 are arranged on a surface of the second substrate 4 facing the first substrate 2 with a distance in between. Black layers 16 are located between the phosphor layers 14 to enhance screen contrast. As a third set of electrodes, an anode electrode 18 is formed by depositing a conductive layer, for example a metallic layer based on aluminum, over the phosphor layers 14 and the black layers 16. The anode electrode 18 is coupled to a high voltage required for accelerating electron beams and heightens screen brightness generated by the phosphor layer 14 through creating a metal back effect.

Figure 2:
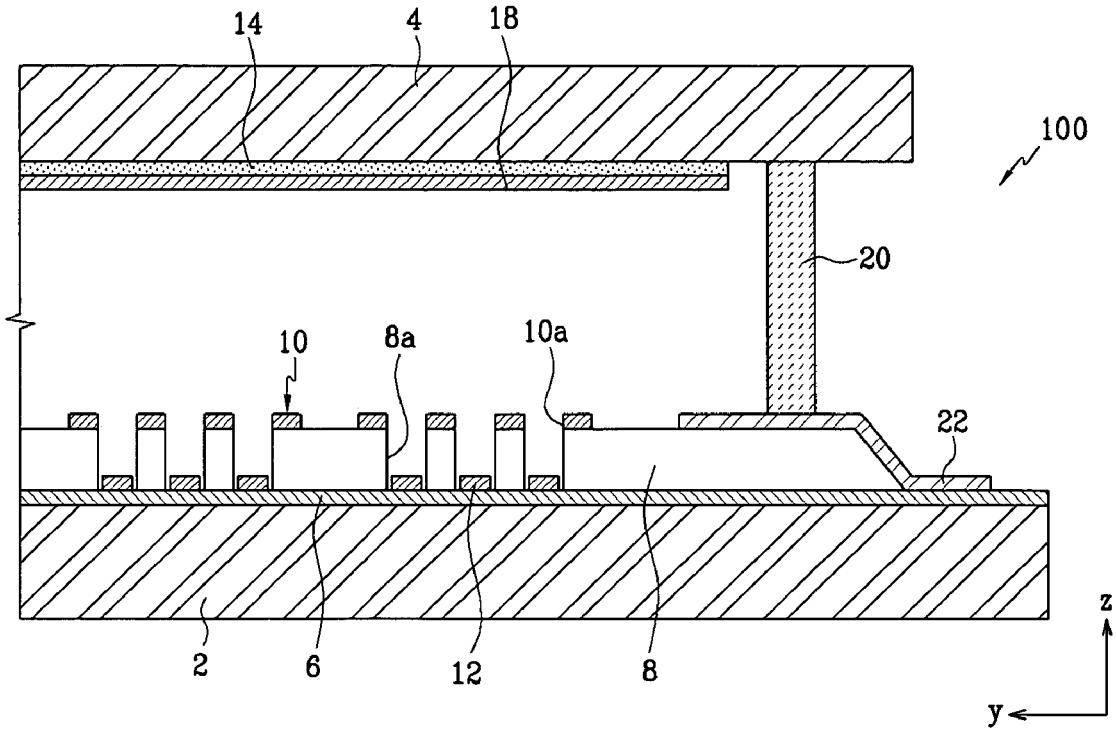
FIG. 2 is a simplified diagram of a partial cross-sectional view of one embodiment of an electron emission device constructed in accordance with the invention.

FIG. 2 is a cross-sectional view of the electron emission device 100 of FIG. 1 in the yz plane of these drawings, cutting along cathode electrodes 6 and across gate electrodes 8. As seen in FIG. 2, in each pixel region, one or more holes or wells, referred to as gate wells 8*a*, 10*a* are formed. The gate wells start in the gate electrodes 10 and end in the insulating layer 8 and are hence referred to as 10*a* corresponding to the portion of the well in the gate electrode 10, or 8*a* corresponding to the portion in the insulating layer 8. Gate wells 8*a*, 10*a* are capable of partially exposing the cathode electrode 6.

Electron emission regions 12 may be formed on the cathode electrode 6 within the gate wells 8*a*, 10*a*. In one embodiment, the electron emission regions 12 may be comprised of a material capable of emitting electrons under the application of an electric field. For example, the electron emission regions 12 may be formed with carbon nanotube, graphite, graphite nanofiber, diamond, diamond-like carbon, C60, silicon nanowire, composites of these material, or like material. The formation of the electron emission regions 12 may be made by direct growing, screen printing, chemical vapor deposition, sputtering, or similar processes. As also seen in FIG. 2, the end portions of the conductive layers 22 are extended to the outside of the sealing member 20 while spreading over the lateral side of the insulating layer 8 and the top surface of the cathode electrodes 6, where the conductive layers 22 contact the cathode electrodes 6.

When driving voltages are applied to the cathode electrodes 6 and gate electrodes 10, an electric field is formed around the electron emission regions 12 due to the voltage difference between the cathode electrodes 6 and gate electrodes 10. Electrons are emitted from the electron emission regions 12 under the influence of the electric field thus created. The anode electrode 18 may be coupled to a high positive voltage required for accelerating electron beams generated in the emission regions 12. Both the acceleration of the electrons and the metal back effect created by the anode increase screen brightness.

In another embodiment, the anode electrode 18 may be formed with a transparent conductive material such as indium tin oxide (ITO) instead of a metallic material. In this embodiment, first an anode electrode (not shown) is formed on the second substrate 4 with a transparent conductive material, then phosphor layers 14 and black layers 16 are formed on the anode electrode. If required, in some embodiments, a metallic layer may be formed on the phosphor layers 14 and the black layers 16 to increase the screen brightness. The anode electrode 18 may be formed on the entire surface of the second substrate 4. In other embodiments, the anode electrode 18 may be formed only on parts of the second substrate 4 according to a predetermined pattern.

Conductive layers 22, in the electron emission device 100, may be used to prevent static charges from accumulating on the portions of the insulating layer 8 in the non-display areas. The conductive layers 22 cover the portions of the insulating layer 8 in the non-display area inside of the sealing member 20, near the internal perimeter of the vacuum chamber, to prevent the static charges generated during the driving of the electron emission device from being accumulated on the insulating layer 8. Because the conductive layers 22 are electrically coupled to the cathode electrodes 6, the conductive layers 22 are driven and controlled by the driving IC for the cathode electrodes 6. Accordingly, in this embodiment of the electron emission device 100, the cathode electrodes 6 and the conductive layers 22 can be driven together with the basic electrode driving IC.

In one embodiment, the conductive layers 22 may be formed together with the gate electrodes 10 by depositing a conductive layer onto the insulating layer 8, and patterning it.

Figure 3:
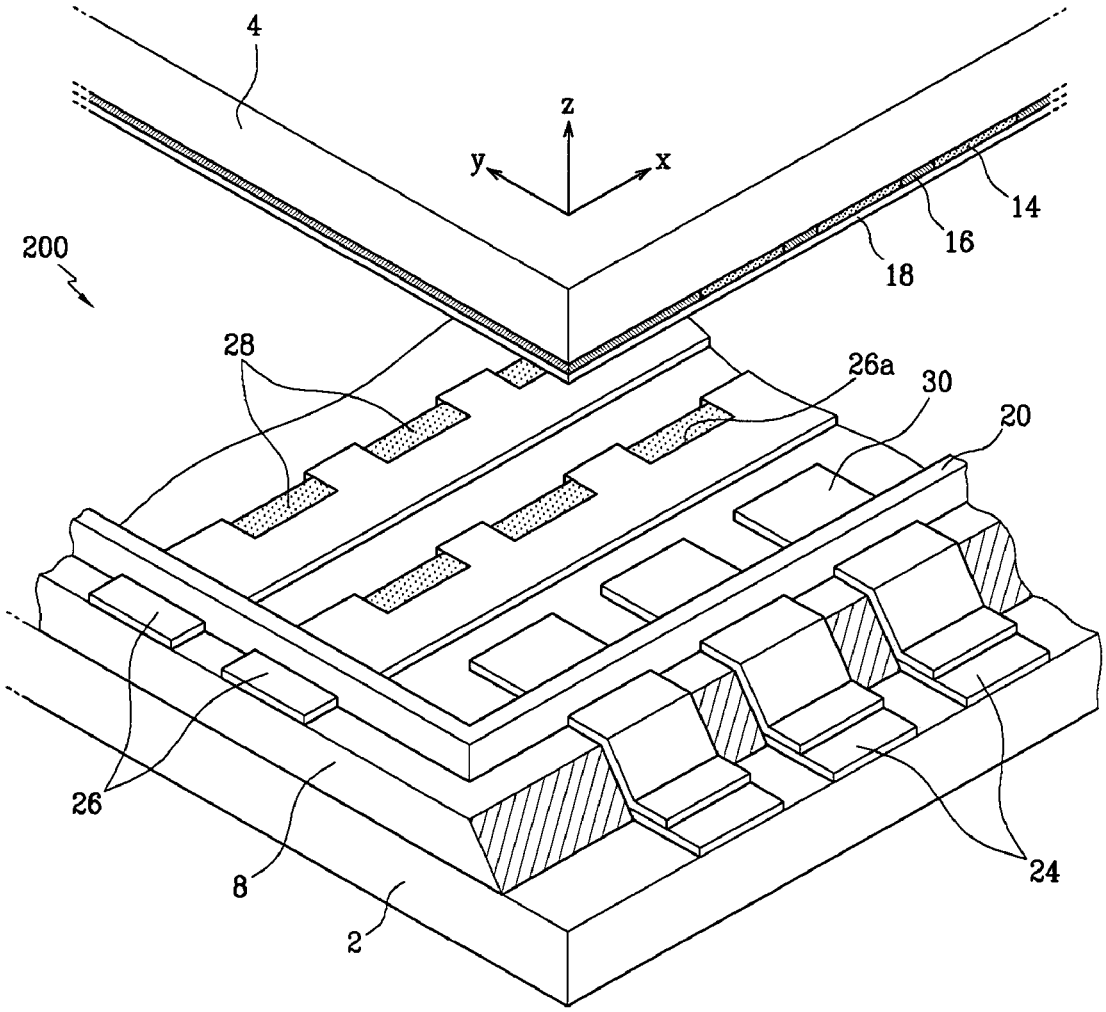
FIG. 3 is a simplified diagram showing, in perspective, a portion of a second embodiment of an electron emission device constructed in accordance with the invention.

FIG. 3 is a partial perspective view of another embodiment 200 of the electron emission device of the present invention.

As seen in FIG. 3, a number of gate electrodes 24 are arranged on a first substrate 2 with a distance in between the gate electrodes 24, that are deposited or formed in parallel stripes. An insulating layer 8 is formed on the entire surface of the first substrate 2 over the gate electrodes 24. The insulating layer 8 covers the gate electrodes 24. A number of cathode electrodes 26 are formed on the insulating layer 8 spaced apart from one another. The cathode electrodes 26 are deposited or formed in parallel stripes that are perpendicular to the gate electrode 24 stripes. Electron emission regions 28 are formed on one side or edge of the cathode electrodes 26. Electron emission regions 28 are formed within wells, depressions, indentations, notches, pits, or hollowed portions 26*a* formed on one edge of the cathode electrodes 26.

In the embodiment of the electron emission device 200 shown in FIG. 3, conductive layers 30 are formed or placed over portions of the insulating layer 8 in the non-display area. The conductive layers 30 may cover the insulating layer 8 in the non-display area. The conductive layers 30 help prevent the accumulation of static charges on the insulating layer 8. The conductive layers 30 extend on one side to the inside wall of the sealing member 20, through the sealing member 20, and to the outside of the vacuum chamber on the other side of the sealing member 20, where the conductive layers 30 are electrically coupled to the gate electrodes 24 that were formed or placed under the insulating layer 8. Accordingly, the conductive layers 30 may be driven by the driving IC for the gate electrodes 24. In some embodiments, a separate driving IC may be used for the gate electrodes 24.

As explained above, the connection between the conductive layers 30 and the gate electrodes 24 prevents static charges from accumulating on the insulating layer 8. This, in turn, may help prevent problems related to the accumulation of the static charges, such as device abnormality, arcing, and flashover.

The electron emission device 100 and the method of preventing the accumulation of static charges may be used with any of the electron emission devices including, for example, FEA devices, SCE devices, MIM devices, MIS devices, BSE devices, or the like.

Although, the foregoing describes exemplary embodiments of the present invention, it should be understood that many variations or modifications of the basic inventive concept, taught here, will fall within the spirit and scope of the present invention as defined in the appended claims.

What is claimed is:

1. An electron emission device comprising:

first electrodes on a substrate in a first pattern;

an insulating layer on the substrate, the insulating layer covering the first electrodes;

second electrodes on the insulating layer in a second pattern; and at least two conductive layers on the insulating layer at a periphery of the insulating layer parallel to the first electrodes, the conductive layers partially covering the insulating layer within the periphery and contacting corresponding ones of the first electrodes outside the periphery.

2. The electron emission device of claim 1, wherein conductive layers are in one to one correspondence with the first electrodes.

3. The electron emission device of claim 2, wherein the conductive layers are electrically coupled to a corresponding first electrode.

4. The electron emission device of claim 1, wherein the first electrode extends beyond the insulating layer and contacts the conductive layer at an outer edge of the insulating layer.

5. The electron emission device of claim 1, further comprising electron emission regions electrically coupled to the first electrodes or to the second electrodes.

6. The electron emission device of claim 5, wherein the second electrodes and the insulating layer have wells partially exposing the first electrodes, and wherein the electron emission regions are on the first electrodes within the wells.

7. The electron emission device of claim 5, wherein the electron emission regions are over the second electrodes.

8. The electron emission device of claim 5, wherein the electron emission regions comprise a material selected from the group consisting of carbon nanotube, graphite, graphite nanofiber, diamond, diamond-like carbon, C60, and silicon nanowire.

9. An electron emission device comprising:

a first substrate and a second substrate facing each other;

first electrodes on the first substrate in a first electrode pattern;

an insulating layer on the first substrate while covering the first electrodes;

second electrodes on the insulating layer in a second electrode pattern;

at least two conductive layers on the insulating layer and inside a perimeter of the insulating layer parallel to the first electrodes while partially covering the insulating layer, the conductive layers being electrically coupled to the first electrodes over the outer edge of the insulating layer;

at least a third electrode on the second substrate; and phosphor layers on a surface of the at least third electrode.

10. The electron emission device of claim 9, wherein the conductive layers are in one to one correspondence with the first electrodes, and wherein the conductive layers are electrically coupled to the corresponding first electrodes.

11. The electron emission device of claim 9, wherein the first electrodes extend beyond the insulating layer and contact the conductive layers at an outer edge of the insulating layer.

12. The electron emission device of claim 9, further comprising electron emission regions electrically coupled to one of the first electrodes and the second electrodes.

13. The electron emission device of claim 1, wherein the first electrode pattern comprises parallel stripes, and wherein the second electrode pattern comprises parallel stripes perpendicular to the stripes of the first pattern.

14. An electron emission device comprising:

a first substrate;

a second substrate facing the first substrate and forming a chamber between the first substrate and the second substrate, wherein a partial vacuum is created in the chamber;

at least one first electrode on the first substrate;

an insulating layer on the first substrate, the insulating layer covering the at least one first electrode;

at least one second electrode on the insulating layer; and a conductive layer parallel to the at least one first electrode, the conductive layer on and partially covering the insulating layer, the conductive layer being electrically coupled to the at least one first electrode outside the chamber and at a periphery of the chamber.

15. A method for preventing accumulation of static charge in an electron emission device, the electron emission device having first electrodes and second electrodes formed over a first substrate, the first electrodes and second electrodes separated by an insulating layer in between, crossings of the first electrodes and second electrodes forming pixel areas, and electron emission regions formed on either the first electrodes or the second electrodes adapted to emit electrons under influence of potentials established at the first electrodes and second electrodes, the electron emission device further having a second substrate opposite the first substrate, the two substrates forming an enclosed chamber containing a partial vacuum inside, the method comprising:

forming conductive layers on the insulating layer parallel to either the first electrodes or the second electrodes, wherein the conductive layers are separated from a corresponding parallel electrode by the insulating layer;

extending the conductive layers to outside of the chamber;

electrically coupling the conductive layer to the corresponding parallel electrode, along an edge of the insulating layer outside the chamber;

discharging electrostatic charges forming on non-pixel areas of the insulator layer through the conductive layer to outside of the chamber.

16. The method of claim 15, further comprising:

driving the conductive layer and the corresponding parallel electrode by a same circuit.

17. The method of claim 15, wherein the conductive layers are near an inner perimeter of the chamber.

18. The method of claim 15, wherein the first electrodes and the second electrodes are in stripe patterns, first electrode stripes running perpendicular to the second electrode stripes.

19. The method of claim 17, wherein the conductive layers are in partial stripes parallel to the first electrodes, the partial stripes extending partially inward from the inner perimeter of the chamber.

20. The method of claim 17, wherein the conductive layers are in partial stripes parallel to the second electrodes, the partial stripes extending partially inward from the inner perimeter of the chamber.

* * * * *